US008846166B2

(12) United States Patent
Herlambang et al.

(10) Patent No.: US 8,846,166 B2
(45) Date of Patent: Sep. 30, 2014

(54) RECORDING MEDIUM

(71) Applicant: Canon Kabushiki Kaisha, Tokyo (JP)

(72) Inventors: Olivia Herlambang, Kawasaki (JP); Yasuhiro Nito, Inagi (JP); Hisao Kamo, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/026,626

(22) Filed: Sep. 13, 2013

(65) Prior Publication Data

US 2014/0099453 A1 Apr. 10, 2014

(30) Foreign Application Priority Data

Oct. 9, 2012 (JP) ..... 2012-224136

(51) Int. Cl.
*B41M 5/00* (2006.01)
*B41M 5/50* (2006.01)
*B41M 5/52* (2006.01)

(52) U.S. Cl.
CPC ..... *B41M 5/502* (2013.01); *B41M 5/52* (2013.01); *B41M 5/5281* (2013.01); *B41M 5/508* (2013.01); *B41M 5/506* (2013.01); *B41M 5/5218* (2013.01); *B41M 5/5245* (2013.01); *B41M 5/5254* (2013.01); *B41M 2205/42* (2013.01)
USPC ..... 428/32.24; 428/32.25; 428/32.28; 428/32.3; 428/32.34

(58) Field of Classification Search
CPC .. B41M 5/506; B41M 5/5218; B41M 5/5254; B41M 5/502; B41M 5/508; B41M 5/5245; B41M 5/5281
USPC ..... 428/32.24, 32.25, 32.28, 32.3, 32.34
See application file for complete search history.

(56) References Cited

U.S. PATENT DOCUMENTS

| | | | | |
|---|---|---|---|---|
| 6,874,881 | B2 | 4/2005 | Suzuki et al. | |
| 6,929,362 | B2 | 8/2005 | Takada et al. | |
| 6,932,465 | B2 | 8/2005 | Nito et al. | |
| 6,935,732 | B2 | 8/2005 | Takada et al. | |
| 7,029,109 | B2 | 4/2006 | Shirota et al. | |
| 7,055,943 | B2 | 6/2006 | Suzuki et al. | |
| 7,208,032 | B2 | 4/2007 | Hakamada et al. | |
| 7,276,110 | B2 | 10/2007 | Tsujimura et al. | |
| 7,276,112 | B2 | 10/2007 | Tokuda et al. | |
| 7,347,890 | B2 | 3/2008 | Nito et al. | |
| 7,354,145 | B2 | 4/2008 | Nito et al. | |
| 7,377,631 | B2 | 5/2008 | Takada et al. | |
| 7,402,200 | B2 | 7/2008 | Imai et al. | |
| 7,517,073 | B2 | 4/2009 | Nito et al. | |
| 7,517,074 | B2 | 4/2009 | Hakamada et al. | |
| 7,537,329 | B2 | 5/2009 | Nito et al. | |
| 7,601,779 | B2 | 10/2009 | Hyakuda et al. | |
| 7,625,614 | B2 | 12/2009 | Kamo et al. | |
| 7,635,182 | B2 | 12/2009 | Hakamada et al. | |
| 7,846,516 | B2 | 12/2010 | Kamo et al. | |
| 7,867,586 | B2 | 1/2011 | Kamo et al. | |
| 8,016,406 | B2 | 9/2011 | Hakamada et al. | |
| 8,153,212 | B2 | 4/2012 | Hyakuda et al. | |
| 8,158,223 | B2 | 4/2012 | Hyakuda et al. | |
| 8,252,392 | B2 | 8/2012 | Oguri et al. | |
| 8,486,499 | B2 | 7/2013 | Nito et al. | |
| 8,524,336 | B2 | 9/2013 | Oguri et al. | |
| 8,609,209 | B2 | 12/2013 | Taguri et al. | |
| 2006/0078694 | A1* | 4/2006 | Motoda et al. | 428/32.24 |
| 2008/0152827 | A1 | 6/2008 | Hakamada et al. | |
| 2011/0135855 | A1 | 6/2011 | Oguri et al. | |
| 2011/0256324 | A1* | 10/2011 | Noguchi et al. | 428/32.24 |

FOREIGN PATENT DOCUMENTS

| | | | |
|---|---|---|---|
| JP | 2005-336480 | A | 12/2005 |
| JP | 2006-051741 | A | 2/2006 |
| JP | 2006-248017 | A | 9/2006 |
| JP | 2006-265525 | A | 10/2006 |

* cited by examiner

*Primary Examiner* — Betelhem Shewareged
(74) *Attorney, Agent, or Firm* — Fitzpatrick, Cella, Harper & Scinto

(57) ABSTRACT

The invention provides a recording medium having a substrate, a first ink receiving layer and a second ink receiving layer which is an outermost layer in this order, wherein the first ink receiving layer contains alumina hydrate and polyvinyl alcohol, the second ink receiving layer contains alumina hydrate, polyvinyl alcohol, a cationic polymer particle and a zirconium compound, and the thickness of the second ink receiving layer is 3 μm or more and 10 μm or less.

4 Claims, No Drawings

RECORDING MEDIUM

BACKGROUND OF THE INVENTION

1. Field of the Invention

The present invention relates to a recording medium.

2. Description of the Related Art

An ink jet recording system is a system in which a minute droplet of an ink is applied to a recording medium such as paper by any one of various working principles, and at the same time, a solvent component on the ink penetrates into the recording medium or evaporates, thereby depositing a coloring material component in the ink on the recording medium to make a record of an image, character and/or the like (hereinafter referred to as "image"). In addition, the ink jet recording system has such features that high-speed printability, noise reducing ability and flexibility of a recording pattern are excellent, a multi-color image can be formed with ease, and development and fixing of the image are unnecessary.

In particular, an image formed by a multi-color ink jet recording system can obtain a record comparable with an image formed by multi-color printing of a plate system or a color photography system. Thus, since the system also has such a merit that a printing cost is cheaper than an ordinary printing or photographic technique when the number of images is small, an apparatus of the multi-color ink jet recording system has been rapidly spread as an image recording apparatus of various information instruments in recent years.

A recording medium comparable with a silver salt photograph is required to have excellent color developability, appearance (in particular, scratch resistance) and preservability. A recording medium, or a recording medium having a coloring material receiving layer composed of a porous structure in particular, has many voids. Thus, a recorded image is liable to be faded by an acidic gas in the air, or ozone in particular. Under the circumstances, the recording medium is not suitable for long-term storage of the image compared with the image of the multi-color printing of the place system or the silver salt photograph. The recording medium having the coloring material receiving layer composed of the porous structure is relatively damaged upon conveyance in a printer compared with a swelling type recording medium whose ink receiving layer is composed of a polymer. There has been a very strong demand for improving preservability and scratch resistance, and many proposals for improving such performance properties have been made to date.

Regarding the improvement in preservability, Japanese Patent Application Laid-Open No. 2005-336480 (Patent Literature 1) and Japanese Patent Application Laid-Open No. 2006-265525 (Patent Literature 2) have proposed the use of, for example, a thioether-group-containing cationic polyurethane for improving various properties such as fade resistance. The cationic polyurethane is contained in an ink receiving layer, whereby excellent preservability (in particular, ozone resistance) can be achieved.

In order to improve the scratch resistance on the other hand, Japanese Patent Application Laid-open No. 2006-051741 (Patent Literature 3) describes a recording medium having an ink receiving layer containing a urethane emulsion as a main component and further containing alumina hydrate, polyvinyl alcohol and an organic acid salt of zirconium. Besides the above, Japanese Patent Application Laid-open No. 2006-246017 (Patent Literature 4) describes a recording medium in which two or more ink receiving layers mainly containing silica are provided, and the outermost layer thereof contains a urethane emulsion and a zirconium compound.

SUMMARY OP THE INVENTION

It is an object of the present invention to provide a recording medium capable of achieving excellent color developability, scratch resistance upon conveyance in a printer and fastness properties (in particular, ozone resistance) and capable of reducing the occurrence of color unevenness (hereinafter referred to as undertrapping) that may occur when printing surfaces are overlaid on each other end is caused by transfer of a solvent between ink receiving layers.

The occurrence or the under trapping is a problem newly recognized in application of recently increasing preparation of a photobook using an ink jet technology. This occurrence of undertrapping will hereinafter be described in detail.

When recording media printed by an ink jet recording system are used in application for the photobook, ink receiving layers respectively provided on the recording media may be overlaid on each other in some cases. At this time, water and a water-soluble solvent contained in an ink used in printing do not completely volatilize, and a part thereof may remain in the ink receiving layers. Therefore, water and the water-soluble solvent may transfer between the overlaid ink receiving layers in some cases. At this time, a difference in the existing amounts of water and the water-soluble solvent is produced between a portion where the transfer of water and the water-soluble solvent has been caused and a portion where the transfer has not been caused, so that in some cases a haze difference may be caused between the ink receiving layers, and the undertrapping may be observed on an image. When high-glossy paper with small surface roughness is used in particular, a contact area between surfaces becomes large, so that the above-described phenomenon becomes more marked.

In the recording media described in Patent Literatures 1 and 2, the improvement in preservability is observed, but scratch resistance upon conveyance in a printer and undertrapping resistance are not considered.

In the recording medium described in Patent Literature 3, alumina hydrate weak in scratch resistance is used in an ink receiving layer. However, amounts of a urethane-based binder and a crosslinking agent are increased, whereby the film surface strength of the ink receiving layer is improved to improve the scratch resistance of the ink receiving layer. In Patent Literature 3, however, the urethane-based binder is a main component of the ink receiving layer, and so sufficient ink absorbency and color developability have not been achieved.

In the recording medium described in Patent Literature 4, since an ink receiving layer is formed by using finely particulate silica as a main component, sufficient ink absorbency is achieved, and a proper amount of a zirconium compound is contained, thereby achieving excellent coating property without causing surface defects. However, color developability is insufficient. In addition, undertrapping resistance is not considered. The present inventors have carried out an investigation on the undertrapping resistance of the recording medium described in Patent Literature 4. As a result, it has been necessary to relatively increase the amounts of water and a water-soluble polymer or a water-dispersible polymer because the silica is used. As a result, the amounts of water and a water-soluble solvent which have not volatilized to be held in the recording medium have increased. Thus, the amount of the water-soluble solvent which can transfer has also increased, resulting in the deterioration of the undertrapping resistance.

Therefore, it as an object of the present invention to provide a recording medium capable of achieving undertrapping resistance said excellent color developability, scratch resistance upon conveyance in a printer and fastness properties (in particular, ozone resistance) at the same time.

The above object can be achieved by the present invention described below. According to the present invention, there is thus provided a recording medium comprising a substrate, a first ink receiving layer and a second ink receiving layer which is an outermost layer in this order, wherein the first ink receiving layer contains alumina hydrate and polyvinyl alcohol, the second ink receiving layer contains alumina hydrate, polyvinyl alcohol, a cationic polymer particle and a zirconium compound, and a thickness of the second ink receiving layer is 3 μm or more and 10 μm or less.

According to the present invention, there can be provided a recording medium capable of achieving undertrapping resistance and excellent color developability, scratch resistance upon conveyance in a printer and fastness properties at the same time.

Further features of the present invention will become apparent from the following description of exemplary embodiments.

DESCRIPTION OF THE EMBODIMENTS

Preferred embodiments of the present invention will now be described in detail.

The recording medium according to the present invention is a recording medium obtained by providing a first ink receiving layer and a second ink receiving layer in this order on a substrate. The first ink receiving layer contains alumina hydrate and polyvinyl alcohol. The thickness of the second ink receiving layer which is an outermost layer is 3 μm or more and 10 μ, or less, and this layer contains alumina hydrate, polyvinyl alcohol, a cationic polymer particle and a zirconium compound. The first and second ink receiving layers may be provided on one surface or both surfaces of the substrate.

No particular limitation is imposed on the substrate used in recording medium, and a paper web such as wood free papery medium-quality paper, coat paper, art paper or cast-coated paper, syntactic paper, a white plastic film, a transparent plastic films, a translucent plastic film, or polymer-coated paper may be used. When the glossiness of an image formed is effectively developed, a substrate high in barrier properties to coating liquids for forming the ink receiving layers is favorable. For example, the following substrate is favorable. Specific examples thereof include white films of plastics such as polyethylene terephthalate, polyvinyl chloride, polycarbonate, polyimide, polyacetate, polyethylene, polypropylene and polystyrene, which have been opacified by blending a pigment such as titanium oxide or barium sulfate and imparting porosity, and the so-called polymer-coated paper webs obtained by laminating a thermoplastic polymer such as polyethylene or polypropylene on base paper.

When image quality and feeling comparable with a silver salt photograph are imparted to a recording medium, the following is mentioned as base paper favorably used as the substrate. That is, polyolefin-polymer-coated paper with at least one surface, on which the ink receiving layer is provided, coated with a polyolefin polymer is favorable, and polyolefin-polymer-coated paper, both surfaces of which are coated with the polyolefin polymer, is more favorable. The polyolefin-polymer-coated paper is favorably such that an average roughness at 10 points in accordance with JIS B 0601 is 0.5 μm or less, and a 60°-specular glossiness in accordance with JIS Z 8741 is 25% or more and 75% or less.

No particular limitation is imposed on the thickness of the polymer-coated paper. However, the thickness is favorably 25 μm or more and 500 μm or less. If the thickness of the polymer-coated paper is 25 μm or more, it can be excellently prevented that the stiffness of the resulting recording medium is lowered, and it can also be excellently prevented that inconvenience such as deterioration of a feel or texture when she recording medium is touched with a hand, or lowering of opacity occurs. If the thickness of the polymer-coated paper is 500 μm or less on the ether hand, it can be excellently prevented that the resultant recording medium becomes rigid and hard to handle, and so paper feeding and conveyance in a printer can be smoothly conducted. The thickness of the polymer-coated paper is more favorably within a range of 50 μm or more and 300 μm or less. No particular limitation is also imposed on the basis weight of the polymer-coated paper. However, it is favorably within a range of 25 g/m$^2$ or more and 500 g/m$^2$ or less.

The ink receiving layer used in this embodiment is composed of at least two layers of a second ink receiving layer which is an outermost layer and a first ink receiving layer which is located between one second ink receiving layer and the substrate. The second ink receiving layer contains alumina hydrate as an inorganic pigment, a zirconium compound, a cationic polymer particle and polyvinyl alcohol. Besides the above, the second ink receiving layer may contain a crosslinking agent.

The first ink receiving layer contains alumina hydrate as an inorganic pigment and polyvinyl alcohol. The first ink receiving layer may contain a crosslinking agent. In addition, the first ink receiving layer may also contain the zirconium compound and the cationic polymer particle within limits not impeding the effect of the present intention.

According to an investigation by the present inventors, the use of the alumina hydrate as an inorganic pigment in the first and second ink receiving layers can more lessen the amount of polyvinyl alcohol necessary as a binder than the use of gas-phase-process alumina or silica. The reason for this is that the gas-phase-process alumina or silica causes large shrinkage in a drying process upon the preparation of the recording medium to easily cause cracking. It is necessary to increase the amount of the binder for relieving this shrinkage. To the contrary, the alumina hydrate causes less shrinkage compared with the gas-phase-process alumina or silica, so that a recording medium which inhibits the occurrence of cracking can be provided even when the amount of the binder is small. When the amount of polyvinyl alcohol is larger, the amounts of water and the water-soluble solvent which have not volatilized to be held in the recording medium are increased as described above. Therefore, the undertrapping is easy to occur. Thus, the alumina hydrate is used, whereby the amount of polyvinyl alcohol can be lessened to reduce the occurrence of undertrapping.

In addition, the cationic polymer particle and the zirconium compound are caused to coexist in the second ink receiving layer, a larger pore can be formed when the second ink receiving layer is applied and dried. As a result, not only the volatilization of water and the water-soluble solvent can be facilitated, but also the haze of the second ink receiving layer can be increased to reduce a haze difference caused by a difference in amounts of water and the water-soluble solvent which are components of an ink, so that the undertrapping resistance can be improved.

In addition, the carbonic polymer particle is caused to be contained in the second ink receiving layer, whereby the fastness properties (in particular, ozone resistance) can be improved. Further, the zirconium compound is caused to be contained in the second ink receiving layer, whereby this compound can act as a crosslinking agent for polyvinyl alcohol to improve the film surface strength of the ink receiving layer and greatly improve the scratch resistance of the ink receiving layer containing the alumina hydrate. As a result, excellent scratch resistance upon conveyance in a printer can be achieved.

However, when all the ink receiving layers contain the zirconium compound and the cationic polymer particle, the hazes of the ink receiving levers may increase in some cases to lower the color developability of the resulting recording medium. Thus, two or more ink receiving layers ere provided in the present invention to cause the cationic polymer particle and the zirconium compound to coexist in at least the second ink receiving layer which is an outermost layer.

The thickness of the second ink receiving layer is 3 μm or more and 10 μm or less. If the thickness of the second ink receiving layer is less than 3 μm, the undertrapping resistance and scratch resistance of the resulting recording medium become insufficient. If the thickness of the second ink receiving layer is more than 10 μm on the other hand, there is a possibility that the haze produced by the coexistence of the cationic polymer particle and the zirconium compound may lower the color developability. Accordingly, the thickness of the second ink receiving layer is controlled to 3 μm or more and 10 μm or less, whereby excellent color developability can be achieved at the same time as the undertrapping resistance and scratch resistance. The thickness of the second ink receiving layer is more favorably within a range of 5 μm or more and 8 μm or less.

As for the crystal structure of the alumina hydrate, amorphous, gibbsite and boehmite types are known according to the temperature of a heat treatment. That having any crystal structure among these may be used as the alumina hydrate.

In order to provide an ink receiving layer having high gloss and high transparency, the average secondary particle size of the alumina hydrate is favorably 50 nm or more and 500 nm or less, more favorably 100 nm or more and 300 nm or less. If the average secondary particle size of the alumina hydrate is less than 50 nm, the ink absorbency of the resulting ink receiving layer may become insufficient in some cases. Accordingly, when printing is conducted by a printer with large ink ejection quantity, bleeding and beading (a phenomenon that an ink cannot be absorbed to cause density unevenness in the form of beads) of an ink may be caused on the ink receiving layer in some cases. If the average secondary particle size is more than 500 nm on the other hand, the specific surface area thereof becomes small, and the resulting ink receiving layer becomes hard to fix a dye, so that sufficient color developability may not be achieved in some cases.

Among the above-mentioned alumina hydrates, alumina hydrate having a boehmite structure or pseudoboehmite structure is particularly favorably used. Such alumina hydrate can form an ink receiving layer particularly high in ink-absorbing capacity, excellent in color developability and capable of forming a high-quality image.

In particular, alumina hydrate having a BET specific surface area within a range of favorably 50 $m^2/g$ or more, more favorably 50 $m^2/g$ or more and 500 $m^2/g$ or less, still more favorably 50 $m^2/g$ or more and 250 $m^2/g$ or less is favorably used. When the BET specific surface area of the alumina hydrate is within the range of 50 $m^2/g$ or more and 250 $m^2/g$ or less, an ink receiving layer containing such alumina hydrate is excellent in ink absorbency, beading resistance and smoothness. If the BET specific surface area of the alumina hydrate is less than 50 $m^2/g$ on the other hand, the transparency and color developability of an ink receiving layer containing such alumina hydrate are lowered, and the resulting image tends to cause undertrapping. If the BET specific surface area of the alumina hydrate exceeds 500 $m^2/g$, a great amount of an acid is required as a deflocculant for stably dispersing such alumina hydrate in water, and the ink absorbency of an ink receiving layer containing such alumina hydrate is lowered.

The alumina hydrate favorably used and having the boehmite structure or pseudoboehmite structure is represented by the following general formula (1).

$$Al_2O_{3-n}(OH)_{2n}\cdot mH_2O \quad (1)$$

wherein n is any of integers of 0, 1, 2 and 3, and m is a value falling within a range of from 0 to 10, favorably from 0 to 5. In many cases, $mH_2O$ represents an aqueous phase which does not participate in the formation of a crystal lattice but is eliminable. Therefore, m may take a value other than an integer. When this kind of alumina hydrate is heated, m may reach a value of 0.

A crystal of the alumina hydrate showing the boehmite structure is generally a layer compound the (020) plane of which forms a macro-plane, and shows a characteristic diffraction peak on an X-ray diffraction pattern. Besides perfect boehmite, a structure called pseudoboehmite and containing excess water between layers of the (020) plane may also be taken as the boehmite structure. The X-ray diffraction pattern of this pseudoboehmite shows a diffraction peak broader than that of the boehmite. Since perfect boehmite and pseudoboehmite may not be clearly distinguished from each other, alumina hydrates including both are called alumina hydrate showing a boehmite structure in the present invention unless expressly noted.

No particular limitation is imposed on a process for producing the alumina hydrate. For example, any method of the Bayer's method and alum pyrolytic method may be adopted. A particularly favorable process is a process in which an acid is added to an aluminum long-chain alkoxide to hydrolyze the alkoxide. The particle form of the alumina hydrate thus obtained can be controlled within a specific range by controlling conditions of an aging process in which a particle is grown through a process of hydrothermal synthesis. Accordingly, when the aging time is properly preset, a primary particle size is grown. Sol obtained herein may also be used as a dispersion liquid as it is by adding an acid as a deflocculant. In order to improve the dispersibility of the alumina hydrate in water, however, it may be allowable to powder the sol by a method such as spray drying and than add an acid to prepare a dispersion liquid. As the acid for deflocculating the alumina hydrate, a conventionally known acid may be used, and examples thereof include organic acids such as formic acid, acetic acid, propionic acid, butyric acid, glycolic acid, lactic acid, pyruvic cid and methanesulfinic acid, and inorganic acids such as hydrochloric acid and nitric acid. One or more acids may be freely chosen for use from among these acids.

As examples of the zirconium compound used in the second ink receiving layer, may be mentioned the following compounds: zirconium acetate, zirconium nitrate, basic zirconium carbonate, zirconium hydroxide, ammonium zirconium carbonate, potassium zirconium carbonate, zirconium sulfate, zirconium fluoride, zirconium chloride, zirconium chloride octahydrate, zirconium oxychloride and zirconium hydroxychloride. Among these zirconium compounds, a compound capable of being stably added into a coating liquid for forming the ink receiving layer is favorable, and zirconium acetate (zirconyl acetate) and zirconium oxychloride are particularly favorable.

The content of the zirconium compound in the second ink receiving layer is more than 5.0% by mass in terms of mass ratio with respect to the content of the alumina hydrate. That is, (content (% by mass) of zirconium compound)/(content (% by mass) of alumina hydrate)×100 is favorably more than 5.0. If the mass ratio is 5.0% by mass or less, the effect to improve the scratch resistance upon conveyance in a printer and the undertrapping resistance may not be sufficiently achieved in some cases.

The cationic polymer particle used in the second ink receiving layer will hereinafter be described. the cationic polymer particle is a cationically modified or cationized polymer particle. In the present invention, the polymer particle means a polymer having a particle size. Specifically, the average particle size of the polymer particle is favorably 5 nm or more, more favorably 10 nm or more. Examples of the cationic polymer particle include those obtained by cationizing emulsions of conjugated diene copolymers such as styrene-butadiene copolymers and methyl methacrylate-butadiene copolymers; emulsions of acrylic polymers such as polymers or copolymers of acrylates and methacrylates, and polymers or copolymers of acrylic acid and methacrylic acid; emulsions of styrene-acrylic polymers such as styrene-acrylate copolymers and styrene-methacrylate copolymers; emulsions of vinyl polymers such as ethylene-vinyl acetate copolymers; and those obtained by cationizing urethane emulsions having a urethane bond with a cationic group, those obtained by cationizing the surfaces of the emulsions with a cationic surfactant, and those obtained by conducting polymerization in the presence of cationic polyvinyl alcohol to distribute the cationic polyvinyl alcohol in the surface of the resultant emulsion. Among these cationic polymer particles, a cationic urethane polymer particle is favorable.

In the present invention, the cationic polymer particle is favorably a cationic urethane polymer particle obtained by reacting at least (A) a sulphur-containing organic compound having two or more active hydroxyl groups, (B) a polyisocyanate compound having two or more isocyanate groups and (C) an amine compound having two or more active hydroxyl groups followed by cationizing at least part of amino groups in the resultant polyaddition reaction product, from the viewpoint of improving the preservability.

Sulphur-Containing Organic Compound A

No particular limitation is imposed on the sulfur-containing organic compound A having two or more active hydroxyl groups which is a compound used in the synthesis of the cationic polymer particle so far as it is a sulphur-containing organic compound having two or more active hydroxyl groups. Among others, however, a compound having at lease one sulfide group in its molecule is favorable from the viewpoint of ozone resistance. As specific examples of the compound A, compounds represented by the following formulae (2) to (7) may be mentioned. One or more of the following compounds A may be caused to react with the compounds B and C to synthesize a polyaddition reaction product, and then some of amino groups thereof are cationized, thereby synthesizing a reaction product forming the cationic polymer particle.

General formula (2)

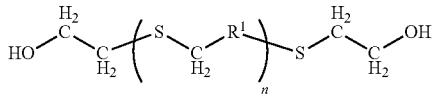

(In the formula, n is 1 or 2, and $R^1$ is a methylene, ethylene or propylene group.)

General formula (3)

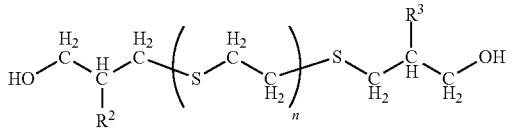

(In the formula, n is 1 or 2, and $R^2$ and $R^3$ are, independently of each other, a hydrogen atom, a hydroxyl group or an alkyl group and may be the same or different from each other. The number of carbon atoms in the alkyl group is favorably 1 or more and 5 or less.)

General formula (4)

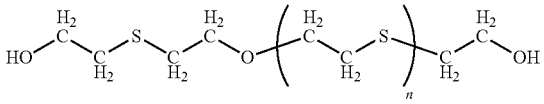

(In the formula, n is 0 or 1.)

General formula (5)

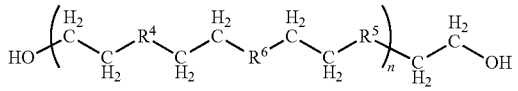

(In the formula, n is 1 or 2, $R^4$ and $R^5$ are, independently of each other, a sulphur or oxygen atom, $R^6$ is a sulphur atom or an $SO_2$ group, with the proviso that $R^4$ and $R^5$ may be the same or different from each other, but $R^4$ and $R^6$, and $R^5$ and $R^6$ are not the same as each other and are respectively formed by different groups.)

General formula (6)

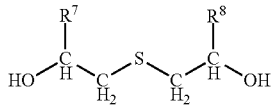

(In the formula, $R^7$ and $R^8$ are, independently of each other, a hydrogen atom or an alkyl group and may be the same or different from each other. The number of carbon atoms in the alkyl group is favorably 1 or more and 5 or less.)

General formula (7)

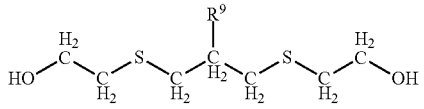

(In the formula, $R^9$ is a hydroxyl group or an alkyl group. The number of carbon atoms in the alkyl group is favorably 1 or more and 5 or less.)

Polyisocyanate Compound B

Examples of the compound B used in the synthesis of the cationic polymer particle include 2,4-tolylene diisocyanate, 2,6-tolylene diisocyanate, m-phenylene diisocyanate, p-phenylene diisocyanate, 4,4'-diphenylmethane diisocyanate, 2,4'-diphenylmethane diisocyanate, 2,2'-diphenylmethane diisocyanate, 3,3'-dimethyl-4,4'-biphenylene diisocyanate, 3,3'-dichloro-4,4'-biphenylene diisocyanate, 1,5-naphthalene diisocyanate, 1,5-tetrahydronaphthalene diisocyanate, tetramethylene diisocyanate, 1,6-hexamethylene diisocyanate, dodecamethylene diisocyanate, trimethylhexamethylene diisocyanate, 1,3-cyclohexylane diisocyanate, 1,4-cyclohexylene diisocyanate, xylylene diisocyanate, tetramethylxylylene diisocyanate, hydrogenated xylylene diisocyanate, lysine diisocyanate, isophorone diisocyanate and 4,4'-dicyclohexylmethane diisocyanate. However, the compound B is not limited thereto. These polyisocyanate compounds B may be used singly or in combination of two or more compounds thereof at the same time to synthesize a reaction produce forming the cationic polymer particle.

Amine Compound C

Examples of the amine compound C having two or more active hydroxyl groups and used in the synthesis of the cationic polymer particle include such tertiary amines as represented by the following general formula (8).

For example, such a tertiary amine as represented by the following general formula (8) is favorable as the compound C used in the synthesis of a reaction product forming the cationic polymer particle.

General formula (8)

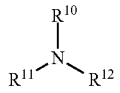

(In the formula, $R^{10}$, $R^{11}$ and $R^{12}$ are individually any one of alkyl, alkanol, aminoalkyl and alkanethiol groups having 1 to 6 carbon atoms, with the proviso that at least two of $R^{10}$, $R^{11}$ and $R^{12}$ are alkanol groups having 1 to 6 carbon atoms.)

Specific examples of the compound C represented by the general formula (8) include diol compounds such as N-methyl-N,N-diethanolamine, N-ethyl-N,N-diethanolamine, N-isobutyl-N,N-diethanolamine, N-t-butyl-N,N-diethanolamine and N-t-butyl-N,N-diisopropanolamine; triol compounds such as triethanoamine; diamine compounds such as methyliminobispropylamine and butyliminobispropylamine; and triamine compounds such as tri(2-aminoethyl)amine. These amine compounds may be used singly or in combination of two or more compounds thereof at the same time to synthesize a reaction product forming the cationic polymer particle.

Blending Amount

As described above, the cationic polymer particle is obtained by causing the compounds A, B and C to react with one another to synthesize a polyaddition reaction product. The polyaddition reaction product is then cationized to obtain a polymer compound containing a compound A unit, a compound B unit and a compound C unit (at least part of amino groups in these units being cationized) in its molecule. The amount of the amine compound C is favorably 5.5% or more and 18.5% or less in terms of molar ratio with respect to all the compounds used for obtaining the polyaddition reaction product (at least each one of the compounds A, B and C and optional, additives such as a compound D which will be described subsequently). When the molar ratio of the amount of the compound C used is 5.5% or more, it can be excellently prevented that the content of a hydrophilic group is lowered and than the preparation of an aqueous dispersion of the cationic polymer particle becomes difficult. When the molar ratio of the amount of the compound C used is 18.5% or less on the other hand, it can be excellently prevented that the glossiness and color developability of the resulting recording medium containing the cationic polymer particle are lowered.

The content of the compound C unit in the cationic polymer particle can be controlled to 3% by mass or more and 80% by mass or less so far as the molar ratio of the compound C used in the polyaddition reaction fails within the above range. When the content is 80% by mass or less, it can be excellently prevented that the lowering of the glossiness and color developability is caused. Incidentally, the mass proportions of the compound A unit, compound B unit and compound C unit in the cationic polymer particle can be respectively calculated from the amounts of the compounds A, E and C charged.

When the amount of the compound c in the polyaddition reaction product falls within the above range, the mass of the compound A unit incorporated into the cationic polymer particle is favorably 10% by mass or more and 65% by mass or less, more favorably 30% by mass or more and 65% by mass or less an the polymer compound (cationic polymer particle). When the proportion of the compound A unit is 10% by mass or more, the resulting ink receiving layer can have an effect of excellent ozone resistance. When the proportion of the compound A unit is 65% by mass or less on the other hand, it can be excellently prevented that the content of a hydrophilic group is relatively lowered and that inconvenience occurs upon the preparation of an aqueous dispersion of the cationic polymer particle.

The compound B has a function of linking the compound A to the compound C, and no particular limitation is imposed on an using amount thereof. When the blending amount of the compound D falls within the above range, however, the mass of the compound B unit is favorably 10% by mass or more and 80% by mass or less, more favorably 30% by mass or more and 60% by mass or less in the resulting cationic polymer particle, When the proportion of the compound B unit is 10% by mass or more and 80% by mass or less, the compound A can be linked to the compound C in respective amounts sufficient to cause the functions of the compound A and compound C units to excellently exhibit.

Production Process of Polyaddition Reaction Product

The process for producing one polyaddition reaction product of the compound A to C may be the so-called one-shot process in which the compounds A to C are caused to react at a time to provide a random polymer. Further, the so-called prepolymer process in which the compound A (or the compound C) is reacted with the compound B to prepare a prepolymer having a terminal isocyanate group, and this prepolymer is reacted with the compound C for the compound A) may also be used. Incidentally, at this time, the compound A (or the compound C) is favorably reacted with the compound B in such a state that the isocyanate group of the compound B is richer than the active hydroxyl group of the compound A (or the compound C). In any process, a chain lengthening agent such as a low-molecular weight polyol or low-molecular weight diamine may also be used in combination. The molecular weight of the resulting polyaddition reaction product can be controlled by changing the amounts of the compounds (A) to (C) used or adding a reaction terminator such as a monoalcohol or monoamine to the reaction system at proper timing.

The weight average molecular weight of the polyaddition reaction product thus obtained varies according to reaction conditions, but is favorably 2,000 or more and 150,000 or less, more preferably 2,000 or more and 50, 000 or less. When the weight average molecular weight of the polyaddition reaction product is 2,000 or more, it can be excellently prevented that the glossiness and printing density are lowered. When the weight average molecular weight is 150,000 or less, it can be excellent prevented that the reaction time becomes long and that production cost increases.

In the production of the polyaddition reaction product, any other compound (hereinafter referred to as "compound D") having two or more active hydrogen groups than the compound (A) and compound (C) may be copolymerized as needed. As examples of such a compound D, may be mentioned such polyester polyols, polyether polyols and polycarbonate polyols as described below. These compounds may be used singly or in combination of two or more compounds thereof at the same time to synthesize the polyaddition reaction product.

Examples of the polyester polyols include polyesters obtained by a dehydration condensation reaction of a glycol component such as ethylene glycol, propylene glycol, 1-propanediol, 1, 4-butanediol, 1,5-pentanediol, 3-methyl-1,5-pentanediol, 1,6-hexanediol, neopentylglycol diol, diethylene glycol, triethylene glycol, tetraethylene glycol, polyethylene glycol having a molecular weight of 300 to 1,000, dipropylene glycol, tripropylene glycol, bishydroxyethoxybenzene, 1,4-cyclohexanedimethanol, bisphenol A, bisphenol S, hydrogenated bisphenol A, hydroquinone and an alkylene oxide adduct, with an acid component such as malonic acid, succinic acid, glutaric acid, adipic acid, pimelic acid, suberic acid, azelaic acid, sebacic acid, hendecanedicarboxylic acid, decanedicarboxylic acid, dodecanedicarboxylic acid, maleic anhydride, furamic acid, 1,3-cyclopentanedicarboxylic acid, terephthalic acid, isophthalic acid, phthalic acid, 1,4-naphthalenedicarboxylic acid, 2,5-naphthalenedicarboxylic acid, 2,6-naphthalenedicarboxylic acid, naphthalic acid, biphenyldicarboxylic acid, 1,2-bisphenoxyethane-p,p'-dicarboxylic acid, ands an anhydride or ester-forming derivative of a dicarboxylic acid, and besides polyesters obtained by a ring-opening polymerization reaction of cyclic ester compounds such as ϵ-caprolactone and copolymerized polyesters thereof.

Examples of the polyether polyols include polymers obtained by using, as an initiator, a compound having at least two active hydrogen atoms, such as ethylene glycol, diethylene glycol, triethylene glycol, propylene glycol, trimethylene glycol, 1,3-butanediol, 1,4-butanediol, 1,5-pentanediol, 1,6-hexanediol, neopentylglycol, glycerol, trimethylolethane, trimethylolpropane, sorbitol, sucrose, bisphenol A, bisphenol S, hydrogenated bisphenol A, aconitic acid, trimellitic acid, hemimellitic acid, phosphoric acid, ethylenediamine, diethylenetriamine, triisopropanolamine, pyrogallol, dihydroxybenzoic acid, hydroxyphthalic acid and 1,2,3-propanetrithiol, and addition-polymerising one or more of monomers such as ethylene oxide, propylene oxide, butylene oxide, styrene oxide, epichlorohydrin, tetrahydrofuran, and cyclohexylene in accordance with a process known per se in the art. A polymer obtained by using, as an initiator, a compound having at least two primary amino groups, such as ethylenediamine or propylenediamine, and addition-polymerising one or more of monomers such as ethylene oxide, propylene oxide, butylene oxide, styrene oxide, epichlorohydrin, tetrahydrofuran and cyclohexylene in accordance with a process known per se in the art may also be used as the polyether polyol.

Examples of the polycarbonate polyols include compounds obtained by a reaction of a glycol such as 1,4-butanediol, 1,6-hexanediol or diethylene glycol with diphenylcarbonate and phosgene.

In the reaction product forming the cationic polymer particle according to the present invention, a tin catalyst and/or an amine catalyst is desirably used in the polyaddition reaction with the isocyanate. Examples of such a tin catalyst include dibutyltin dilaurate and stannous octoate, and examples of the amine catalyst include triethylenediamine, triethylamine, tetramethylpropanediamine tetramethylbutanediamine and N-methylmorphonine. However, the catalysts are not limited thereto.

The polyaddition reaction with the isocyanate may also be conducted without using a solvent according to the composition. However, a hydrophilic organic solvent which does not directly participate in the isocyanate polyaddition reaction system is generally used as a reaction solvent for the purpose of inhibiting the reaction of the reaction system and controlling a base viscosity. Example of such a hydrophilic organic solvent include ketones such as acetone, methyl ethyl ketone, methyl isobutyl ketone, diisobutyl ketone, organic acid esters such as methyl formate, ethyl formate, propyl formate, butyl formate, methyl acetate, ethyl acetate, propyl acetate, butyl acetate, methyl propionate, ethyl propionate and butyl propionate, and amines such as N,N-dimethylformamide and N-methylpyrrolidone. The hydrophilic organic solvent used is favorably finally removed.

Cationized Polyaddition Reaction Product

At least a part of the compound C unit in the cationic polymer particle is cationized, and so the particle can be stably dispersed or dissolved in water in particular. the cationized polyaddition reaction product can be obtained by cationizing the polyaddition reaction product. as a method for this cationization, cationization with an acid may be mentioned. Other methods include a method of cationizing with a quaternizing agent such as an alkyl halide. However, the method of quaternizing with the acid is favorable from the viewpoint of stably dispersing or dissolving the resulting particle with a favorable particle size in water. No particular limitation is imposed on the acid used herein. However, at least one of phosphoric acid and a monovalent acid is favorable. Examples of phosphoric acid include phosphoric acid and phosphorous acid, and examples of the monovalent acid include organic acids such as formic acid, acetic acid, propionic acid, butyric acid, glycolic acid, lactic acid, pyruvic acid and methanesulfinic acid, and inorganic acids such as hydrochloric acid and nitric acid. When a cationic polymer particle cationized with a hydroxy acid such as glycolic acid or lactic acid is used, yellowing of a non-printed portion (white portion) is particularly inhibited compared with a case where other acids are used. Thus, such an acid may be more favorably used.

Particularly favorable compounds among the polymer compounds obtained by such a process as described above are represented by the following general formulae (9) to (14).

General formula (9)

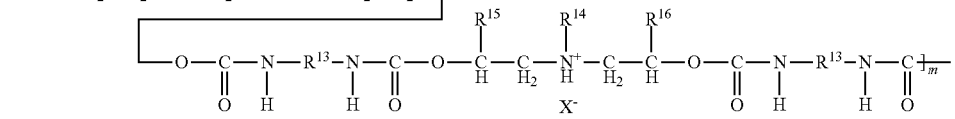

(In the formula, n is 1 or 2, $R^1$ is a methylene, ethylene or propylene group, $R^{13}$ is an alkylene group or an aliphatic hydrocarbon group containing one or more alicycles, $R^{14}$ is an alkyl group having 1 to 4 carbon atoms, $R^{16}$ and $R^{16}$ are, independently of each other, a hydrogen atom or a methyl group, $X^-$ is an acidic negative ion, and m is such a number that the weight average molecular weight of the compound amounts to 1,000 to 150,000.)

(In the formula, n is 1 or 2, $R^4$ and $R^5$ are, independently of each other, a sulphur or oxygen atom, $R^6$ is a sulphur atom or a $SO_2$ group, with the proviso that $R^4$ and $R^5$ may be the same or different from each other, but $R^4$ and $R^6$, and $R^5$ and $R^6$ are not the same as each other and are respectively formed by different groups, and $R^{13}$ to $R^{16}$, $X^-$ and m have the same meanings as defined in the general formula (9).)

General formula (10)

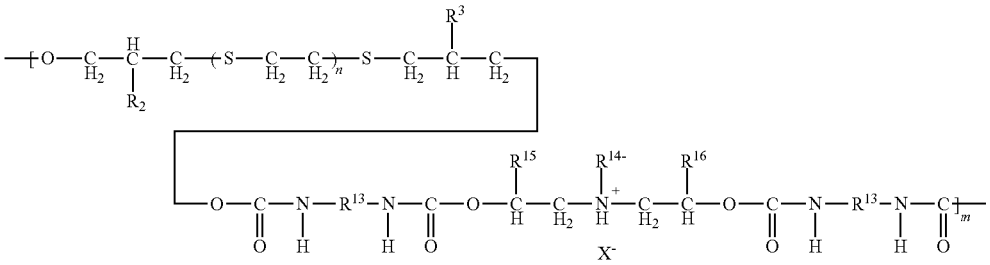

(In the formula, n is 1 or 2, $R^2$ and $R^3$ are, independently of each other, a hydrogen atom, a hydroxyl group or an alkyl group and may be the same or different from each other, and $R^{13}$ to $R^{16}$, $X^-$ and m have the same meanings as defined in the general formula (9).)

General formula (11)

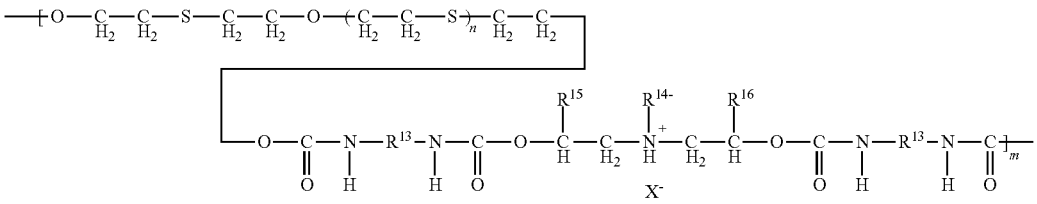

(In the formula, n is 1 or 2, and $R^{13}$ to $R^{16}$, $X^-$ and m have the same meanings as defined in the general formula (9).).

General formula (12)

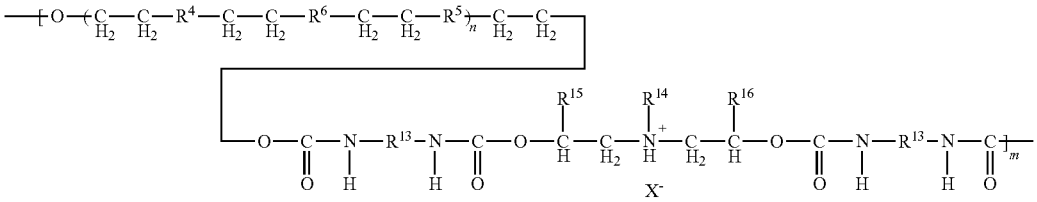

General formula (13)

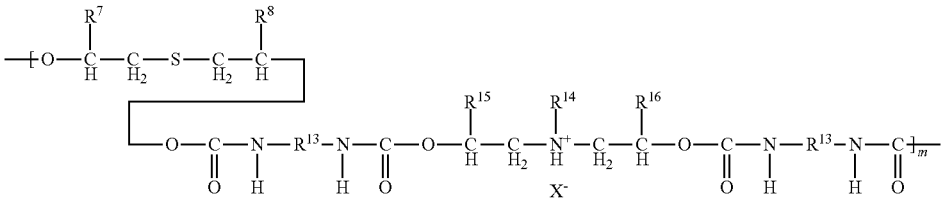

(In the formula, $R^7$ and $R^8$ are, independently of each other, a hydrogen atom or an alkyl group and may be the same or different from each other, and $R^{13}$ and $R^{16}$, $X^-$ and m have the same meanings as defined in the general formula (9).)

General formula (14)

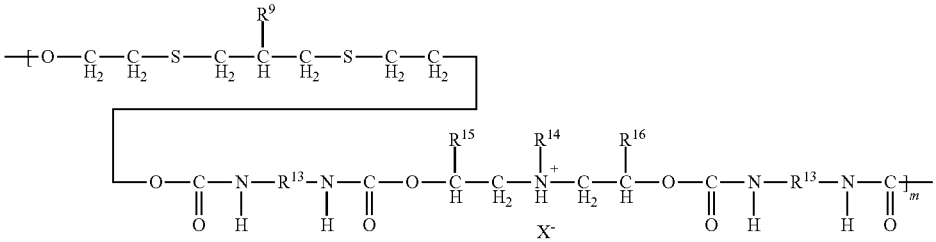

(In the formula, $R^9$ is a hydroxyl group or an alkyl group, and $R^{13}$ to $R^{16}$, $X^-$ and m have the same meanings as defined in the general formula (9).)

Incidentally, the reaction produce forming the cationic polymer particle may be either in a state of being dissolved in water or an organic solvent or in a state of being finely dispersed therein. However, the state of being dispersed in water is more favorable.

The reason why the fading of color change of an image formed on the resulting recording medium due to an acidic gas (in particular, ozone gas) in the air is prevented will hereinafter be described. It is inferred that the sulphur group contained in the reaction product has reducibility and reduces the ozone gas, thereby lowering the oxidizability of the ozone gas to a dye.

The content of the cationic polymer particle in the second ink receiving layer is favorably 2.0% by mass in terms of mass ratio with respect to the content of the alumina hydrate. That is, (content (% by mass) of cationic polymer particle)/(content (% by mass) of alumina hydrate)×100 is favorably 2.0 or more. If the content of the cationic polymer particle is less than 2.0% by mass, the effect to improve the undertrapping resistance may not be sufficiently achieved in some cases.

Polyvinyl alcohol is used together with the alumina hydrate in the first and second ink receiving layers to form an ink receiving layer. As the polyvinyl alcohol, for example, completely or partially saponified polyvinyl alcohol or a modified product thereof (such as a cationically modified product, anionically modified product or silanol-modified product) may be used. Among these, polyvinyl alcohol obtained by hydrolyzing polyvinyl acetate and having a weight average polymerization degree of 300 or more and 5,000 or less is favorable. The saponification degree thereof is favorably 70% by mol or more and less than 100% by mol.

Other materials than polyvinyl alcohol, for example, gelatin and casein and modified products thereof, cellulose derivatives such as methyl cellulose, carboxymethyl cellulose, hydroxyethyl cellulose, urea polymers, melamine polymers, epoxy polymers, epichlorohydrin polymers, polyurethane polymers, polyethylene-imine polymers, polyamide polymers, polyvinyl pyrrolidone polymers, polyvinyl butyral polymers, poly(meth)acrylic acid and copolymers thereof, acrylamide polymers, maleic anhydride copolymers, polyester polymers, SBR latexes, NBR latexes, methyl methacrylate-butandiene copolymer latexes, latexes of acrylic polymers such as acrylic ester copolymers, latexes of vinyl polymers such as ethylene-vinyl acetate copolymers, and functional group-modified polymer latexes obtained by adding a cationic group or anionic group to these various polymer latexes, may be used in the first and second ink receiving layers. These materials may be used either singly or in any combination thereof.

The mixing ratio of the alumina hydrate to the polyvinyl alcohol in the first and second ink receiving layers is within a range of favorably from 1:1 to 30:1, more favorably from 1.5:1 to 20:1 in terms of mass ratio of the alumina hydrate to the polyvinyl alcohol. When the amount of the polyvinyl alcohol falls within this range, first and second ink receiving layers to be formed are particularly hard to cause cracking and powdery coming-off and also have particularly good ink absorbency.

The second ink receiving layer contains the zirconium compound having a function as a crosslinking agent. However, a crosslinking agent may also be added into the first and second ink receiving layers for improving film forming property, water resistance and strength. Examples of the crosslinking agent include epoxy-containing crosslinking agents, and inorganic crosslinking agents, such as boron compounds such as boric acid, and water-soluble aluminum salts.

When the boron compound is used as the crosslinking agent in the first ink receiving layer, the amount used varies according to the total amount of the polyvinyl alcohol used as a binder. However, the boron compound may be generally added in a proportion of 0.1% by mass or more and 30% by mass or less based on the total amount of the polyvinyl alcohol. When the content of the boron compound is 0.1% by mass or more based on the total amount of the polyvinyl alcohol, it can be excellently prevented that the film forming property is lowered, and so excellent water resistance can be achieved. When the content is 30% by mass or less on the other hand, it can be excellently prevented that change of the viscosity of a coating liquid with time becomes great, and than coating stability is lowered. The ink receiving layers may contain various additives capable of being added to a coating liquid for an ink receiving layer which will be described subsequently.

As examples of the boron compound, borax, boric acid, borates, diborates, metaborates, tetraborates and pentaborates may be mentioned. Among these, borax, boric acid and borates are favorable in that the crosslinking reaction can be rapidly caused, and boric acid is particularly favorable.

The first and second ink receiving layers may contain the following materials as needed.

Cationic Polymer

Besides the above, the ink receiving layers may contain a cationic polymer as a dye fixer. In the present invention, the cationic polymer means a polymer having no particle size. the cationic polymer can improve the dyeing property of a magenta dye in particular in the ink receiving layers to inhibit ink seeping out (migration) of the magenta dye typified by an anthrapyridone or quinacridone dye under a high-temperature and high-humidity environment.

pH Adjustor

Into the coating liquids for the first and second ink receiving layers, may be suitably added, as a pH adjustor, for example, any of the following acids and salts: formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, asparagic acid, glutamic acid, pimelic acid, suberic acid, methanesulfonic acid, inorganic acids such as hydrochloric acid, nitric acid and phosphoric acid, and salts of the above-described acids.

Additives

In addition, a pigment dispersant, a thickener, a flowability modifier, an antifoaming agent, a foam inhibitor, a surfactant, a parting agent, a penetrant, a coloring pigment and a coloring dye may also be used as other additives for the coating liquids. Further, a fluorescent whitening agent, an ultraviolet absorbent, an antioxidant, a preservative, a mildew-proofing agent, a water-proofing agent, a dye fixer, a hardener and a weathering agent may also be suitably added as needed.

No particular limitation is imposed on a solid content concentration in the coating liquids for forming the first and second ink receiving layer so far as the coating liquid has such a viscosity that an ink receiving layer can be formed on the substrate. However, the solid content concentration is favorably 5 to 50% by mass, more favorably 15 to 30% by mass based on the total mass of the coating liquid. If the solid content concentration is less than 5% by mass, it is necessary to increase a coating amount for thickening the thicknesses of the first and second ink receiving layers. In this case, drying requires lots of time and energy, so that such a coating liquid may be uneconomical in some cases. If the solid content concentration, exceeds 50% by mass on the other hand, the viscosity of such a coating liquid becomes high, so that the coating property of the coating liquid may be lowered in some cases.

As a method for preparing the coating liquid for the second ink receiving layer, it is favorable that a dispersion liquid of the cationic polymer particle and the zirconium compound are added into a dispersion liquid of the alumina hydrate, the resultant mixture is left to stand for 6 hours or more, and the polyvinyl alcohol is then added. The mixture is left to stand for 6 hours or more, whereby an aggregate of the cationic polymer particle and the zirconium compound becomes stable, and the haze of the resulting second ink receiving layer is sufficiently improved when the coating liquid is applied, thereby achieving excellent undertrapping resistance. When the content of the zirconium compound in the second ink receiving layer is more than 5.0% by mass based on the content of the alumina hydrate, the coating liquid for the second ink receiving layer is favorably applied within 30 minutes after the coating liquid is prepared. In this case, the coating liquid for the second ink receiving layer can be applied before gelling caused by crosslinking occurs to form a second ink receiving layer having stable properties.

As a method for coating the substrate with the thus-prepared coating liquid, any conventionally known coating method may be applied. For example, coating by a coating system such as blade coating, air-knife coating, curtain die coating, slot die coating, bar coating, gravure coating or roll coating is feasible. Thereafter, drying is conducted by means of a drying device such as a hot air dryer, heated drum or far infrared dryer, whereby the first and second ink-receiving layers can be formed. Incidentally, the first and second ink-receiving layers may be formed by changing the compositional ratio of the alumina hydrate to the other additives, and may also be formed on one surface or both surfaces of the substrate. In order to improve the resolution of an image formed and the conveyability of the resulting recording medium, the ink-receiving layers may also be subjected to a smoothing treatment by means of a device such as a calendering or casting device.

The coating liquids for the ink receiving layers may be applied successively or simultaneously for forming at least the first and second ink receiving layers to form an ink receiving layer. With respect to drying after the application, the application and drying may be conducted for every layer, or drying may be conducted after all the coating liquids are applied.

The favorable range of a coating amount of the first and second ink receiving layers on the substrate is 5 g/m$^2$ or more and 50 g/m$^2$ or less in terms of solid. When the coating amount is 5 g/m$^2$ or more, the formed ink receiving layer can sufficiently absorb water in an ink, and so it can be excellently prevented that the ink runs, or an image formed blurs. When the coating amount of the ink receiving layer is 50 g/m$^2$ or less, it can be excellently prevented that curling occurs upon drying, and occurrence of cracks can be particularly reduced to achieve such a marked effect as expected on printing performance.

The present invention will hereinafter be described specifically by the following Examples. However, the contents of the present invention are not limited to the examples/

Substrate

A substrate was prepared under the following conditions. A paper stock having the following composition was first adjusted with water so as to give a solid content concentration of 3% by mass. Incidentally, "part" or "parts" in the following examples means "part by mass" or "parts by mass" unless expressly noted.

Composition of Paper Stock

| | |
|---|---|
| Pulp<br>(80 parts of Laulholz bleached kraft pulp (LBKP, freeness: 450 ml CSF (Canadian Standard Freeness) and 20 parts of Nadelholz bleached kraft pulp (NBKP, freeness: 480 ml CSF)) | 100 parts |
| Cationized starch | 0.60 parts |

-continued

| | |
|---|---|
| Ground calcium carbonate | 10 parts |
| Precipitated calcium carbonate | 15 parts |
| Alkyl ketene dimer | 0.10 parts |
| Cationic polyacrylamide | 0.03 parts. |

Paper was then made from this paper stock by a Fourdrinier paper machine, subjected to 3-stage wet pressing and dried by a multi-cylinder dryer. The resultant paper was then impregnated with an aqueous solution of oxidized starch by a size press so as to give an impregnating amount of 1.0 g/m$^2$, and dried. After the drying, the paper was finished by a machine calender to obtain base paper having a basis weight of 170 g/m$^2$, a Stöckigt sizing degree of 100 seconds, a gas permeability of 50 seconds, a Bekk smoothness of 30 seconds and a Gurley stiffness of 11.0 mN.

A polymer composition composed of low density polyethylene (70 parts), high density polyethylene (20 parts) and titanium oxide (10 parts) was applied in an amount of 25 g/m$^2$ on one side of the base paper. A polymer composition composed of high density polyethylene (50 parts) and low density polyethylene (50 parts) was further applied in an amount of 25 g/m$^2$ on the other side of the base paper, thereby obtaining a polymer-coated substrate.

Aqueous Dispersion Liquid of Cationic Polymer Particle

Preparation Process of Aqueous Dispersion Liquid 1 of Cationic Polymer Particle

Aqueous Dispersion Liquid 1 of a cationic polymer Particle was prepared in the following manner.

After a reaction vessel equipped with a stirrer, a thermometer and a reflux condenser was charged with 109 g of acetone as a reaction solvent, and 40.00 g of 3,6-dithia-1,8-octanediol and 6.79 g of methyldiethanolamine were dissolved under stirring, the resultant solution was heated to 40° C., and 62.07 g of isophorone diisocyanate was added. Thereafter, the resultant mixture was heated to 50° C., 0.2 g of a tin catalyst was added, and the mixture was heated further to 55° C. to conduct a reaction for 4 hours with stirring.

After completion of the reaction, the reaction solution was cooled to room temperature, and 3.09 g of 85% formic acid was added to cationize a reaction product. After 446 g of water was additionally added, the resultant mixture was concentrated under reduced pressure to remove acetone, and the concentration of the mixture was adjusted with water, thereby preparing Aqueous Dispersion Liquid 1 of cationic polymer particles having a solid content of 20% by mass. The average particle size of the resultant cationic particles was measured by means of a laser particle size analysis system, PAR III (trade name; manufactured by OTSUKA ELECTRONICS Co., Ltd.). As a result, the average particle size was 50 nm.

Dispersion Liquid of Inorganic Pigment

Preparation of Alumina Hydrate Dispersion Liquid 1

| | |
|---|---|
| Water | 335 parts |
| Alumina hydrate (Disperal HP-13, product of SASOL Co.) | 100 parts |
| Methanesulfonic acid | 1.5 parts. |

Methanesulfonic acid was added into water as a dispersion medium and the alumina hydrate was then added to disperse the alumina hydrate by a homogenizer, thereby preparing Alumina Hydrate Dispersion Liquid 1 having an alumina hydrate concentration of 23% by mass. The average particle size of the alumina hydrate was 160 nm.

Preparation of Gas-Phase-Process Silica Dispersion Liquid 1

| | |
|---|---|
| Water | 430 parts |
| Denatured ethanol | 22 parts |
| Cationic polymer (SHALLOL DC902P, dimethyldiallylammonium chloride homopolymer, product of DAI-ICHI KOGYO SEIYAKU CO., LTD., average molecular weight: 9,000) | 3 parts |
| Gas-phase-process silica (average particle size: 7 nm, specific surface area by the BET method: 300 m$^2$/g) | 100 parts. |

The dimethyldiallylammonium chloride homopolymer was added into water as a dispersion medium and denatured ethanol, and the gas-phase-process silica was then added to preliminarily disperse the silica, thereby preparing a crude dispersion liquid. This crude dispersion liquid was then treated twice by a high-pressure homogenizer to prepare a dispersion liquid of the gas-phase-process silica having a silica concentration of 20% by mass. The average particle size of she gas-phase-process silica was 100 nm.

Ink Receiving Layer Coating liquid:

An ink receiving layer coating liquid was prepared according to the following composition, and water was added in such a manner that the concentration of the coating liquid is 17% by mass.

Composition of Ink Receiving Layer Coating Liquid (A1)

| | |
|---|---|
| Alumina Hydrate Dispersion Liquid 1 (in terms of solid content of the alumina hydrate) | 100 parts |
| Polyvinyl alcohol PVA 235 (product of Kuraray Co., Ltd., saponification degree: 88%, average polymerization degree: 3,500) | 9.5 parts |
| Boric acid | 2.3 parts |
| Zirconium acetate | 1.0 part. |

Composition of Ink Receiving Layer Coating Liquid (A2)

| | |
|---|---|
| Gas-Phase-Process Silica Dispersion Liquid 1 (in terms of solid content of the gas-phase-process silica; prepared according to the above-described preparation process) | 100 parts |
| Boric acid | 3 parts |
| Polyvinyl alcohol (saponification degree: 88%, average polymerization degree: 3,500) | 22 parts |
| Cationic water-soluble polymer (polyallylamine, PAA-HCl-3L, product of Nitto Boseki Co., Ltd.) | 1 part |
| 1,1,5,5-Tetramethylcarbohydrazide | 2 parts |
| Surfactant (betaine-based; Suwanol AM-2150, product of Nihon Surfactant Kogyo K.K.) | 0.1 parts. |

Composition of Ink Receiving Layer Coating Liquid (B1)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 6.0 parts |
| Cationic Polymer particle Aqueous Dispersion Liquid 1 | 4.0 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B2)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 5.1 parts |
| Cationic Polymer particle Aqueous Dispersion Liquid 1 | 4.0 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B3)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 4.0 parts |
| Cationic Polymer particle Aqueous Dispersion Liquid 1 | 4.0 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B4)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 6.0 parts |
| Cationic Polymer particle Aqueous Dispersion Liquid 1 | 2.0 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B5)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 6.0 parts |
| Cationic Polymer particle Aqueous Dispersion Liquid 1 | 1.0 part |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B6)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 6.0 parts |
| Superflex 620 (product of DAI-ICHI KOGYO SEIYAKU CO., LTD.) | 1.0 part |
| Polyvinyl alcohol PVA 235 (product of Kuraray Co., Ltd., saponification degree: 88%, average polymerization degree: 3,500) | 9.7 parts |
| Boric acid | 2.3 parts. |

Incidentally, the above "Superflex 620" corresponds to the cationic polymer particle dispersion liquid.

Composition or Ink Receiving Layer Coating Liquid (B7)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 6.0 parts |
| Styrene-acrylic cationic emulsion SE2220 (product of Seiko PMC Co., Ltd.) | 1.0 part |
| Polyvinyl alcohol PVA 235 (product of Kuraray Co., Ltd., saponification degree: 88%, average polymerization degree: 3,500) | 9.7 parts |
| Boric acid | 2.3 parts. |

Incidentally, the above "Styrene-acrylic cationic emulsion SE2220" corresponds to a cationic polymer particle dispersion liquid.

Composition of Ink Receiving Layer Coating Liquid (B8)

| | |
|---|---|
| Alumina Hydrate Dispersion Liquid 1 (in terms of solid content of the alumina hydrate) | 100 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B9)

| | |
|---|---|
| Alumina Hydrate Dispersion Liquid 1 (in terms of solid content of the alumina hydrate) | 100 parts |
| Cationic Polymer particle Aqueous Dispersion Liquid 1 | 4.0 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B10)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 6.0 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B11)

| | |
|---|---|
| Alumina Hydrate Dispersion Liquid 1 (in terms of solid content of the alumina hydrate) | 100 parts |
| Zirconium acetate (Zircosol ZA-20, product of DAIICH KIGENSO KAGAKU KOGYO CO., LTD.) | 6.0 parts |
| Cationic polymer "PAS92" (product of Nitto Boseki Co., Ltd.) | 4.0 parts |
| Polyvinyl alcohol PVA 235 (product of Kuraray Co., Ltd., saponification degree: 88%, average polymerization degree: 3,500) | 9.7 parts |
| Boric acid | 2.3 parts. |

Composition of Ink Receiving Layer Coating Liquid (B12)

| | |
|---|---|
| Gas-Phase-Process Silica Dispersion Liquid 1 (in terms of solid content of the gas-phase-process silica) | 100 parts |
| Boric acid | 3.0 parts |
| Polyvinyl alcohol (saponification degree: 88%, average polymerization degree: 3,500) | 20.0 parts |
| Zirconium acetate (Zircosol ZA-20, product of DAIICH KIGENSO KAGAKU KOGYO CO., LTD.) | 6.0 parts |
| Cationic Polymer particle Aqueous Dispersion Liquid 1 | 4.0 parts |
| Surfactant (betaine-based; Suwanol AM-2150, product of Nihon Surfactant Kogyo K.K.) | 0.3 parts. |

Composition, of Ink Receiving layer Coating Liquid (B13)

The following compositions end compounds were first mixed to prepare a liquid composition.

| | |
|---|---|
| Alumina hydrate dispersion liquid (solid content: 6% by mass, "Alumina Sol 520", product of NISSAN CHEMICAL INDUSTRIES, LTD.) | 30% by mass |
| Urethane emulsion dispersion liquid (solid content: 27% by mass, "E-2500", product of DAI-ICHI KOGYO SEIYAKU, CO., LTD.) | 60% by mass |
| Polyvinyl alcohol ("GL-05", product of THE NIPPON SYNTHETIC CHEMICAL INDUSTRY CO., LTD.) | 3% by mass |
| Zirconium organic acid salt solution (solid content: 1.9% by mass, "ZB115", product of Matsumoto Pharmaceutical Manufacture Co., Ltd.) | 7% by mass. |

A urethane emulsion contained in the urethane emulsion dispersion liquid was a nonionic urethane emulsion. The polymerization degree and saponification degree of the polyvinyl alcohol was 500 and 86.5 to 89 mol/L, respectively. The contents of components left by removing liquid components from the liquid composition were as follows: alumina hydrate:urethane emulsion:polyvinyl alcohol:zirconium organic acid salt=15.8% by mass:71.2% by mass:7.9% by mass:5.0% by mass.

Composition of Ink Receiving Layer Coating Liquid (B14)

| | |
|---|---|
| Gas-Phase-Process Silica Dispersion Liquid 1 (in terms of solid content of the gas-phase-process silica) | 100 parts |
| Boric acid | 3.0 parts |
| Polyvinyl alcohol (saponification degree: 88%, average polymerization degree: 3,500) | 20.0 parts |
| Cationic emulsion (Styrene-acrylic; SE2220, product of Seiko PMC Co., Ltd.) | 4.0 parts |
| Zirconium acetate (Zircosol ZA-20, product of DAIICH KIGENSO KAGAKU KOGYO CO., LTD.) | 4.0 parts |
| Surfactant (betaine-based; Suwanol AM-2150, product of Nihon Surfactant Kogyo K.K.) | 0.3 parts. |

Incidentally, the above "Cationic emulsion" corresponds to a cationic polymer particle.

Example 1

Ink Receiving Layer Coating Liquid (A1) was bar-coated as a first ink receiving layer on the substrate prepared in the above-described manner so as to give a coating amount of 28 g/m$^2$, and dried at 60° C. Thereafter, Ink Receiving Layer Coating Liquid (B1) was bar-coated as a second ink receiving layer on the first ink receiving layer so as to give a coating amount of 7 g/m$^2$, and dried at 60° C., thereby obtaining a recording medium of this example. The following evaluations 2 to 5 were made on the resultant recording medium.

Ink Receiving Layer Coating Liquid (A1) and Ink Receiving Layer Coating Liquid (B1) were respectively coated as a first ink receiving layer and a second ink receiving layer on a transparent polyester film (100Q80D, product by Toray Co. Ltd., thickness: 100 μm) by the same process as described above, thereby obtaining a recording medium of this example. The following evaluation 1 was made on the resultant recording medium. Results are shown in Table 1.

Example 2

In Example 1, the flow rates of the coating liquids were adjusted in such a manner that the coating amounts of the first and second ink receiving layers are 32 g/m$^2$ and 3 g/m$^2$, respectively. Recording media of this example were prepared in the same manner as in Example 1 except for the above-described condition, and the following evaluations 1 to 5 were made. Results are shown in Table 1.

Example 3

In Example 1, the flow rates of the coating liquids were adjusted in such a manner that the coating amounts of the first and second ink receiving layers are 25 g/m$^2$ and 10 g/m$^2$, respectively. Recording media of this example were prepared in the same manner as in Example 1 except for the above-described condition, and the following evaluations 1 to 5 were made. Results are shown in Table 1.

Example 4

Recording media of this example were pared in the same manner as in Example 1 except that Ink Receiving Layer Coating Liquid (B2) was used for the second ink receiving layer in Example 1, and the following evaluations 1 to 5 were made. Results are shown in Table 1.

Example 5

Recording media of this example were prepared in the same manner as in Example 1 except that Ink Receiving Layer Coating Liquid (B3) was used for the second ink receiving layer in Example 1, and the following evaluations 1 to 5 were made. Results are shown in Table 1.

Example 6

Recording media of this example were prepared in the same manner as in Example 1 except that Ink Receiving Layer Coating Liquid (B4) was used for the second ink receiving layer in Example 1, and the following evaluations 1 to 5 were made. Results are shown in Table 1.

Example 7

Recording media of this example were prepared in the same manner as in Example 1 except that Ink Receiving Layer Coating Liquid (B5) was used for the second ink receiving layer in Example 1, and the following evaluations 1 to 5 were made. Results are shown in Table 1.

Example 8

Recording media of this example were prepared in the same manner as in Example 1 except that Ink Receiving Layer Coating Liquid (B6) was used for the second ink receiving layer in Example 1, and the following evaluations 1 to 5 were made. Results are shown in Table 1.

Example 9

Recording media of this example were prepared in the same manner as in Example 1 except that Ink Receiving Layer Coating Liquid (B7) was used for the second ink receiving layer in Example 1, and the following evaluations 1 to 5 were made. Results are shown in Table 1.

Comparative Example 1

A recording medium was prepared in the same manner as in Example 1 except that Ink Receiving Layer Coating Liquid (B1) was coated on the substrate prepared in the above-described manner so as to give a coating amount of 35 g/m$^2$, and the following evaluations 1 to 5 were made. Results are shown in Table 1.

Comparative Example 2

Recording media of this example were prepared in the same manner as in Example 1 except that the flow rates of the coating liquids in Example 1 were adjusted in such a manner that the coating amounts of the first and second ink receiving layers are 34 g/m$^2$ and 1 g/m$^2$, respectively, and the following evaluations 1 to 5 were made. Results are shown in Table 1.

Comparative Example 3

Recording media of this example were prepared in the same manner as in Example 1 except that the flow rates of the coating liquids in Example 1 were adjusted in such a manner that the coating amounts of the first and second ink receiving layers are 23 g/m$^2$ and 12 g/m$^2$, respectively, and the following evaluations 1 to 5 were made. Results are shown in Table 1.

Comparative Example 4

Recording media of this example were prepared in the same manner as in Example 1 except that Ink Receiving Layer Coating Liquid (B8) was used for the second ink receiving layer (a layer most distant from the substrate) in Example 1, and the following evaluations 1 to 5 were made. Results are shown in Table 1.

Comparative Example 5

Recording media of this example were prepared in the same manner as in Example 1 except that Ink Receiving Layer Coating Liquid (B9) was used for the second ink receiving layer (a layer most distant from the substrate) in Example 1, and the following evaluations 1 to 5 were made. Results are shown in Table 1.

Comparative Example 7

Recording media of this example were prepared in the same manner as in Example 1 except that Ink Receiving Layer Coating Liquid (B11) was used for the second ink receiving layer (a layer most distant from the substrate) in Example 1, and the following evaluations 1 to 5 were made. Results are shown in Table 1.

Comparative Example 8

In Example 1, the coating amount of Ink Receiving Layer Coating Liquid (A2) was changed to 19 g/m$^2$ to form a first ink receiving layer (a layer near to the substrate), and the coating amount of Ink Receiving Layer Coating Liquid (B12) was changed to 5 g/m$^2$ to form a second ink receiving layer (a layer most distant from the substrate), and the coating amount of Ink Receiving Layer Coating Liquid (B12) was changed to 5 g/m$^2$ to form a second ink receiving layer (a layer most distant from the substrate). Recording media were prepared in the same manner as in Example 1 except for the above-described condition, and the following evaluations 1 to 5 were made. Results are shown in Table 1.

Comparative Example 9

Two grams of Ink Receiving Layer Coating Liquid (B13) was coated respectively on a polyvinyl chloride-made substrate and a transparent polyester film (100Q80D, product by Toray Co. Ltd., thickness: 100 μm) by means of a bar coater No. 20 and dried for 5 minutes at 70° C., thereby forming an ink receiving layer to obtain recording media, and the following evaluations 1 to 5 were made. Results are shown in Table 1.

Comparative Example 10

Ink Receiving Layer Coating Liquid (A2) as a first ink receiving layer (a layer near to a substrate) and Ink Receiving Layer Coating Liquid (B14) as a second ink receiving layer (a layer distant from a substrate) were simultaneously double-layer-coated on the substrate. The coating amount of the finely particulate silica in Ink Receiving Layer Coating Liquid (A2) was controlled to 12 g/m$^2$, and the coating amount of the finely particulate silica in Ink Receiving Layer Coating Liquid (B14) was controlled to 8 g/m$^2$. Drying after the coating was conducted under the drying conditions where hot air of 30 to 55° C. was blown after cooling for 20 seconds at 10° C. The following evaluations 1 to 5 were made on the resultant recording media. Results are shown in Table 1.

Evaluation

Evaluation 1: Haze

Haze values on the side of an ink receiving layer of a recording medium obtained by providing the ink receiving layer on a transparent substrate and of the transparent substrate were measured by means of a haze meter (NDH-2000, manufactured by NIPPON DENSHOKU INDUSTRIES CO., LTD.). A difference between the haze values of the recording medium with the ink receiving layer provided and the transparent substrate was calculated as haze.

Evaluation 2: Coloring OD

A solid image was printed on the side of the ink receiving layer of each recording medium prepared above in an ink amount of 100% with a black ink (Bk) by an ink jet recording apparatus (iP4600, manufactured by Canon Inc.). An optical density after the printing was measured by means of an optical reflection densitometer ("530" SPECTRAL DENSITOMETER, manufactured by X-Rite Co.).

5: 2.10 or more;

4: 2.00 or more, but less than 2.10;

3: 1.90 or more, but less than 2.00;

2: 1.80 or more, but less than 1.90;

1: less than 1.90.

Evaluation 3: Scratch Resistance Upon Conveyance in a Printer

Each recording medium prepared above was evaluated as a surface scratch upon conveyance in high-speed printing. The surface scratch upon conveyance is a phenomenon recognized as a scratch by the situation that the glossiness of a contact portion of the recording medium is changed by contact with a hard member such as a roller supporting the recording medium upon conveyance. An apparatus obtained by modifying Pro9000 (manufactured by Canon Inc.) was used as an apparatus for evaluation, and conspicuousness of a scratch was visually evaluated upon printing of a black solid image. The visual evaluation was made under two environments of an office environment (Environment 1) and an outdoor environment (Environment 2). The scratch was more conspicuous under the outdoor environment because strong light of direct sunshine was applied.

5: Scratch was not conspicuous at all under both Environment 1 and Environment 2;

4: Scratch was not conspicuous at all under Environment 1, but somewhat conspicuous under Environment 2;

3: Scratch was somewhat conspicuous under both Environment 1 and Environment 2;

2: Scratch was somewhat conspicuous under Environment 1, but very conspicuous under Environment 2;

1: Scratch was very conspicuous under both Environment 1 and Environment 2.

5: The O.D. residual ratio is 85% or more;

4: The O.D. residual ratio is 80% or more, but less than 85%;

3: The O.D. residual ratio is 75% or more, but less than 80%;

2: The O.D. residual ratio is 70% or more, but less than 75%;

1: The O.D. residual ratio is less than 70%;

Evaluation 5: Undertrapping Resistance

The following images were printed on each recording medium prepared above by means of an ink jet printer (iP4600, manufactured by Canon Inc.).

Image 1: an image solid-printed on a region of 15 cm by 15 cm at (R, G, B)=(0, 0, 0) by an RGB mode in PhotoShop 7.0.

Image 2: An image solid-printed on a region of 5 cm by 5 cm at (R, G, B)=(255,255,0) by an RGB mode in PhotoShop 7.0.

After the printing, the recording media were dried for 30 minutes under an environment of 23° C. and 60% RH, and the recording media were then overlaid on each other in such a manner that Image 1 and Image 2 come into contact with each other, and stored for 24 hours. After the storage for 24 hours, ΔE between a portion of Image 1 overlaid on Image 2 and a portion of Image 1 not overlaid on Image 2 was calculated from measured Lab values (Rd-918, product of Gretag Macbeth Co.).

5: ΔE is less than 0.2;

4: ΔE is 0.2 or more, but less than 0.3;

3: ΔE is 0.3 or more, but less than 0.5;

2: ΔE is 0.5 or more, but less than 0.7;

1: ΔE is less than 0.7.

TABLE 1

| | | Lower layer | | | Outermost layer | | | Effect | | | | |
|---|---|---|---|---|---|---|---|---|---|---|---|---|
| | | Coating liquid | Coating amount ($g/m^2$) | Thickness (μm) | Coating liquid | Coating amount ($g/m^2$) | Thickness (μm) | Haze | Coloring OD | Scratch resistance upon conveyance in printer | Ozone resistance | Undertrapping resistance |
| Example | 1 | A1 | 28 | 28 | B1 | 7 | 7 | 46 | 5 | 5 | 5 | 5 |
| | 2 | A1 | 32 | 32 | B1 | 3 | 3 | 35 | 5 | 5 | 5 | 4 |
| | 3 | A1 | 25 | 25 | B1 | 10 | 10 | 52 | 3 | 5 | 5 | 5 |
| | 4 | A1 | 28 | 28 | B2 | 7 | 7 | 35 | 5 | 5 | 5 | 4 |
| | 5 | A1 | 28 | 28 | B3 | 7 | 7 | 28 | 5 | 5 | 5 | 3 |
| | 6 | A1 | 28 | 28 | B4 | 7 | 7 | 36 | 5 | 5 | 4 | 4 |
| | 7 | A1 | 28 | 28 | B5 | 7 | 7 | 25 | 5 | 5 | 4 | 3 |
| | 8 | A1 | 28 | 28 | B6 | 7 | 7 | 43 | 5 | 5 | 3 | 5 |
| | 9 | A1 | 28 | 28 | B7 | 7 | 7 | 42 | 5 | 4 | 3 | 5 |
| Comparative Example | 1 | | | | B1 | 35 | 35 | 83 | 1 | 5 | 5 | 5 |
| | 2 | A1 | 34 | 34 | B1 | 1 | 1 | 28 | 5 | 2 | 4 | 2 |
| | 3 | A1 | 23 | 23 | B1 | 12 | 12 | 60 | 1 | 5 | 5 | 5 |
| | 4 | A1 | 28 | 28 | B8 | 7 | 7 | 18 | 5 | 1 | 2 | 1 |
| | 5 | A1 | 28 | 28 | B9 | 7 | 7 | 21 | 5 | 2 | 5 | 1 |
| | 6 | A1 | 28 | 28 | B10 | 7 | 7 | 19 | 5 | 5 | 3 | 1 |
| | 7 | A1 | 28 | 28 | B11 | 7 | 7 | 20 | 5 | 5 | 3 | 1 |
| | 8 | A2 | 19 | 28 | B12 | 5 | 7 | 50 | 3 | 5 | 5 | 2 |
| | 9 | | — | | B13 | 16 | 16 | 45 | 2 | 5 | 3 | 5 |
| | 10 | A2 | 15 | 22.5 | B14 | 11 | 16 | 55 | 3 | 4 | 3 | 2 |

Evaluation 4: Ozone Resistance

Gray patches of 256 gradations were printed by means of an ink jet recording apparatus (iP4600, manufactured by Canon Inc.). A patch that has a Bk O.D. value nearest to 1.0 was exposed to ozone to evaluate ozone resistance by a ratio between O.D. values before and after the exposure (O.D. residual ration). Conditions for the exposure to ozone were controlled to 23° C., 50% RH, an ozone concentration of 10 ppm and an ozone exposure time of 40 hours.

OD residual ratio (%)=(OD after test/OD before test)×100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-224136, filed Oct. 9, 2012, which is hereby incorporated by reference herein in its entirety.

What is claimed is:

1. A recording medium comprising, in this order, a substrate, a first ink receiving layer, and a second ink receiving layer that is an outermost layer, wherein the first ink receiving layer contains alumina hydrate and polyvinyl alcohol, the second ink receiving layer contains alumina hydrate, polyvinyl alcohol, a cationic polymer particle, and a zirconium compound, a thickness of the second ink receiving layer is 3 mm or more and 10 mm or less, and a content (% by mass) of the zirconium compound in the second ink receiving layer is more than 5.0% by mass in terms of mass ratio with respect to a content (% by mass) of the alumina hydrate.

2. The recording medium according to claim 1, wherein a content (% by mass) of the cationic polymer particle in the second ink receiving layer is 2.0% by mass or more in terms of mass ratio with respect to a content (% by mass) of the alumina hydrate.

3. The recording medium according to claim 1, wherein the cationic polymer particle is a cationic urethane polymer particle.

4. The recording medium according to claim 3, wherein the cationic urethane polymer particle is obtained by subjecting a sulphur-containing organic compound (A) having two or more active hydroxyl groups, a polyisocyanate compound (B) having two or more isocyanate groups, and an amine compound (C) having two or more active hydroxyl groups to polyaddition and cationizing of some amino groups.

* * * * *